US007311814B2

(12) United States Patent
Guyomar et al.

(10) Patent No.: US 7,311,814 B2
(45) Date of Patent: Dec. 25, 2007

(54) PROCESS FOR THE PRODUCTION OF HYDROCARBON FLUIDS

(75) Inventors: Pierre-Yves Guyomar, Wezembeek-Oppem (BE); Andre A. Theyskens, Wemmel (BE)

(73) Assignee: ExxonMobil Chemical Patents Inc., Houston, TX (US)

( * ) Notice: Subject to any disclaimer, the term of this patent is extended or adjusted under 35 U.S.C. 154(b) by 588 days.

(21) Appl. No.: 10/383,177

(22) Filed: Mar. 6, 2003

(65) Prior Publication Data

US 2004/0020826 A1 Feb. 5, 2004

(30) Foreign Application Priority Data

Mar. 6, 2002 (EP) ..... 02251586

(51) Int. Cl.
*C10G 47/00* (2006.01)
*C10G 65/00* (2006.01)

(52) U.S. Cl. ..... 208/108; 208/14; 208/58; 208/89; 208/111.01; 208/111.3; 208/111.35; 208/216 R; 208/216 PP; 208/251 H; 208/254 H; 507/103; 508/201; 508/485

(58) Field of Classification Search ..... 208/89, 208/111.01, 111.3, 111.35, 216 R, 216 PP, 208/251 H, 254 H, 14, 58, 108; 507/103; 508/201, 485
See application file for complete search history.

(56) References Cited

U.S. PATENT DOCUMENTS

| | | | | |
|---|---|---|---|---|
| 3,364,134 | A | 1/1968 | Hamblin | |
| 3,502,572 | A | 3/1970 | Stolfa | 208/108 |
| 3,664,957 | A * | 5/1972 | McCabe | 508/201 |
| 3,759,817 | A | 9/1973 | Mills et al. | |
| 3,862,025 | A | 1/1975 | Steele et al. | 208/109 |
| 4,036,734 | A | 7/1977 | Manne et al. | 208/57 |
| 4,082,647 | A | 4/1978 | Hutchings et al. | 208/78 |
| 4,347,121 | A | 8/1982 | Mayer et al. | 208/58 |
| 4,347,124 | A | 8/1982 | Shimoiizaka et al. | 209/1 |
| 4,435,275 | A | 3/1984 | Derr et al. | 208/89 |
| 4,447,315 | A | 5/1984 | Lamb et al. | 208/99 |

(Continued)

FOREIGN PATENT DOCUMENTS

EP 0885921 12/1998

(Continued)

OTHER PUBLICATIONS

U.S. Appl. No. 10/382,787, filed Mar. 6, 2003, entitled "Improved Hydrocarbon Fluids", Inventors: Pierre-Yves Guyomar et al. (2002M012).

(Continued)

*Primary Examiner*—Glenn Caldarola
*Assistant Examiner*—Prem C. Singh
(74) *Attorney, Agent, or Firm*—Andrew B. Griffis

(57) ABSTRACT

Hydrocarbon fluids are produced by hydrocracking a vacuum gas oil stream, fractionating and/or hydrogenating the hydrocracked vacuum gas oil. The fluids typically have ASTM D86 boiling point ranges within the range 100° C. to 400° C. the range being no more than 75° C., they also have a naphthenic content greater than 60%, the naphthenics containing polycyclic materials, an aromatic content below 2% and an aniline point below 100° C. The fluids are particularly useful as solvents, for printing inks, drilling fluids, metal working fluids and as silicone extenders.

20 Claims, 1 Drawing Sheet

U.S. PATENT DOCUMENTS

Figure 1:
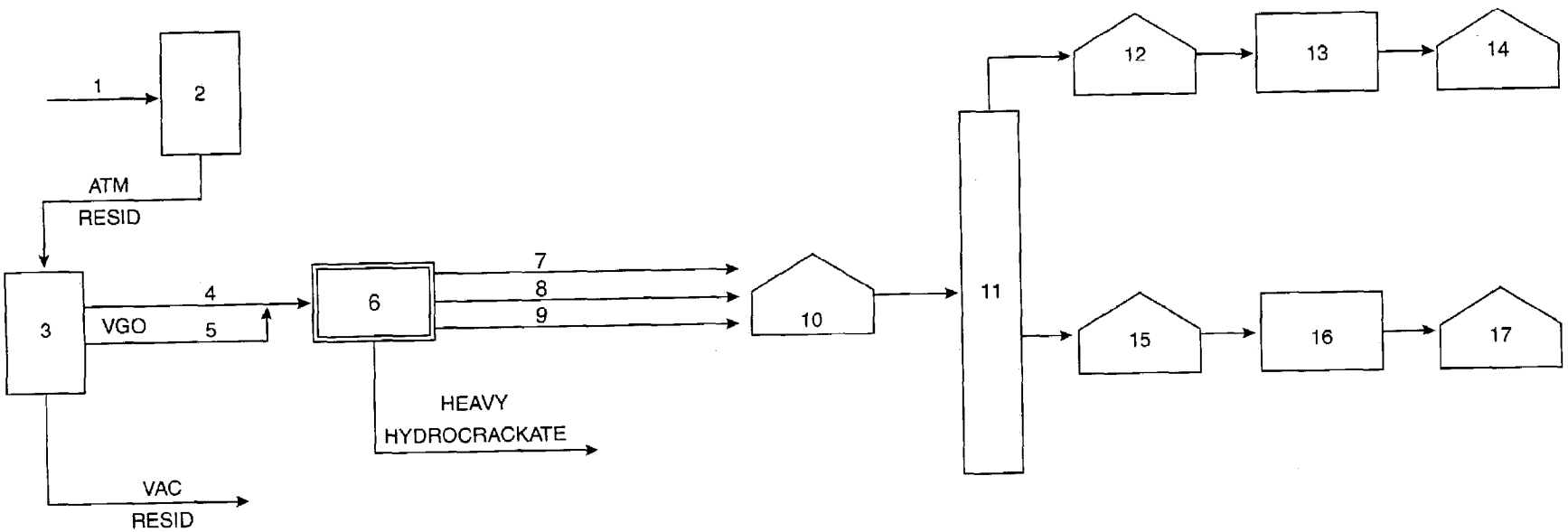

| | | | | |
|---|---|---|---|---|
| 4,719,022 | A | 1/1988 | Hyde | 252/35 |
| 4,795,840 | A | 1/1989 | Torii et al. | 585/16 |
| 4,859,312 | A | 8/1989 | Miller | 208/111 |
| 4,925,546 | A | 5/1990 | Kukes et al. | 208/111 |
| 4,963,247 | A | 10/1990 | Belinko et al. | 208/112 |
| 5,013,422 | A | 5/1991 | Absil et al. | 208/27 |
| 5,015,360 | A | 5/1991 | Degnan et al. | 208/110 |
| 5,333,698 | A | 8/1994 | Van Slyke | 175/65 |
| 5,558,766 | A | 9/1996 | Prada et al. | 208/59 |
| 5,620,590 | A | 4/1997 | Absil et al. | 208/111 |
| 5,635,457 | A * | 6/1997 | Van Slyke | 507/103 |
| 5,755,955 | A | 5/1998 | Benham et al. | 208/112 |
| 5,833,838 | A | 11/1998 | Heyse et al. | 208/48 R |
| 5,954,944 | A * | 9/1999 | Zhang et al. | 208/89 |
| 6,096,690 | A | 8/2000 | Wittenbrink et al. | 507/103 |
| 6,326,338 | B1 | 12/2001 | Garrett | 508/589 |
| 6,410,488 | B1 * | 6/2002 | Fefer et al. | 507/103 |
| 6,858,569 | B2 * | 2/2005 | Yokota et al. | 508/485 |
| 2001/0042699 | A1 | 11/2001 | Cash et al. | 208/58 |

FOREIGN PATENT DOCUMENTS

| | | |
|---|---|---|
| GB | 2135691 | 9/1984 |
| WO | WO 97/23582 | 7/1997 |
| WO | WO 99/47626 | 9/1999 |
| WO | WO 01/83640 | 11/2001 |

OTHER PUBLICATIONS

"Petro Canada Lubricants Handbook for the Year 2000".
"Hydrocarbon Processing," Nov. 1996-pp. 124-126, 128.

* cited by examiner

PROCESS FOR THE PRODUCTION OF HYDROCARBON FLUIDS

CROSS-REFERENCE TO RELATED APPLICATIONS

This application claims priority to European Patent Application No. 02251586.0, filed Mar. 6, 2002.

BACKGROUND OF THE INVENTION

The present invention relates to hydrocarbon fluids and their uses. Hydrocarbon fluids find widespread use as solvents such as in adhesives, cleaning fluids, solvents for decorative coatings and printing inks, light oils for use in applications such as metalworking and drilling fluids. The hydrocarbon fluids can also be used as extender oils in systems such as silicone sealants and as viscosity depressants in plasticised polyvinyl chloride formulations. Hydrocarbon fluids may also be used as solvents in a wide variety of other applications such as chemical reactions.

The chemical nature and composition of hydrocarbon fluids varies considerably according to the use to which the fluid is to be put. Important properties of hydrocarbon fluids are the distillation range generally determined by ASTM D-86 or the ASTM D-1160 vacuum distillation technique used for heavier materials, flash point, density, Aniline Point as determined by ASTM D-611, aromatic content, viscosity, colour and refractive index. Fluids can be classified as paraffinic such as the Norpar® materials marketed by ExxonMobil Chemical Company, isoparaffinic such as the Isopar® materials marketed by ExxonMobil Chemical Company; dearomatised fluids such as the Exxsol® materials, marketed by ExxonMobil Chemical Company; naphthenic materials such as the Nappar® materials marketed by ExxonMobil Chemical Company; non-dearomatised materials such as the Varsol® materials marketed by ExxonMobil Chemical Company and the aromatic fluids such as the Solvesso® products marketed by ExxonMobil Chemical Company.

Unlike fuels fluids tend to have narrow boiling point ranges as indicated by a narrow range between Initial Boiling Point (IBP) and Final Boiling Point (FBP) according to ASTM D-86. The Initial Boiling Point and the Final Boiling Point will be chosen according to the use to which the fluid is to be put however, the use of the narrow cuts provides the benefit of a precise flash point which is important for safety reasons. The narrow cut also brings important fluid properties such as a better defined viscosity, improved viscosity stability and defined evaporation conditions for systems where drying is important, better defined surface tension, aniline point or solvency power.

These hydrocarbon fluids are derived from the refining of refinery streams in which the fluid having the desired properties is obtained by subjecting the most appropriate feed stream to fractionation and purification. The purification typically consists of hydrodesulphurisation and/or hydrogenation to reduce the sulphur content or, in some instances, eliminate the presence of sulphur and to reduce or eliminate aromatics and unsaturates. Traditionally aliphatic hydrocarbon fluids are produced from the products of atmospheric distillation such as virgin or hydro-skimmed refinery petroleum cuts which are deeply hydrodesulphurised and fractionated. If a dearomatised fluid is required the product that has been deeply hydrodesulphurised and fractionated may be hydrogenated to saturate any aromatics that are present. Hydrogenation can also occur prior to the final fractionation.

There is currently a trend towards the use of fluids with extremely low levels of aromatics, extremely low sulphur levels and with higher initial boiling points. These requirements are driven by environmental and/or safety considerations and/or specific end-uses. The existing processes in which a light gas oil or virgin gas oil obtained from atmospheric distillation is first hydrofined and, if required, hydrogenated are limited to feeds with a maximum ASTM D-86 Final Boiling Point (FBP) of 320° C. Feeds with higher boiling points, which tend to also have higher sulphur levels can render the life of the hydrogenation catalyst too short and the higher content of aromatics in these feeds also limits the material that can be hydrogenated in an economic manner. Generally the boiling range of hydrocarbon fluids is measured using the atmospheric boiling measurement technique ASTM D-86 or its equivalents. However, ASTM D-86 is typically used to measure boiling temperatures up to around 370° C., more typically up to 360° C. If however the fluid contains a fraction boiling above 365° C. it may be more convenient to use the ASTM D-1160 technique which measures the distillation temperature using vacuum techniques. Although the fluids specifically discussed herein are stated to have ASTM D-86 boiling points the boiling range of a fluid having a final boiling point above 365° C. may be measured by ASTM D-1160.

Further requirements for hydrocarbon fluids are that they have good cold flow properties so that their freezing points are as low as possible. There is also a need for improved solvency power particularly when the fluids are used as solvents for printing inks where it is necessary that they readily dissolve the resins used in the ink formulations.

Typically in a refinery the crude oil is first subject to atmospheric distillation to obtain the useful light products. Hydrocarbon fluids which find widespread use as solvents in a wide variety of applications, such as cleaning fluids, ink, metal working, drilling fluids and extenders such as in silicone oils and viscosity depressants for polymer plastisols are obtained from the products of atmospheric distillation. The residue from the atmospheric distillation is then subject to vacuum distillation to take off vacuum gas oil. Vacuum gas oil from the vacuum distillation may then be subjected to cracking to produce upgrade materials. Hydrocracking is a technique that is frequently used to upgrade vacuum gas oil.

Hydrocarbon fluids have high purity requirements; generally sulphur levels below 10 ppm, preferably below 5 wt ppm and frequently less than 1 wt ppm. These very low levels of sulphur are measured by ASTM D-4045. The specifications for hydrocarbon fluids usually require low levels of aromatics. The fluids also need to satisfy tight ASTM D-86 distillation characteristics. These fluids are typically obtained from one of the side streams of atmospheric distillation. However, the sulphur and aromatics content of these side streams, especially from the second or third side streams, tend to be high and these increase as the final boiling point of the stream increases. Accordingly it is necessary to hydrodesulphurise these side streams from atmospheric distillation to remove the sulphur and hydrogenate the streams to remove the aromatics. In practice, this places an upper limit of about 320° C. on the final boiling point of the stream that can be used because the heavy, higher boiling molecules are more difficult to desulphurise and need to be hydrofined at a higher temperature. This in turn leads to an increase in the formation of coke in the reactor. In practice therefore, it is currently not possible with atmospheric streams to get efficiently below 50 ppm of sulphur at final boiling points above 320° C.

Hydrocracking is a technique that is often used in refineries to upgrade vacuum gas oil distilled out of residue from atmospheric distillation or to convert heavy crude oil cuts into lighter and upgraded material such as kerosene, jet fuel, distillate, automotive diesel fuel, lubricating oil base stock or steam cracker feed. In hydrocracking the heavy molecules are cracked on specific catalysts under high hydrogen partial vapour pressure. Typically hydrocracking is performed on material corresponding to crude cut points between 340° C. and 600° C. and boiling in the range 200° C. to 650° C. as measured by ASTM D-1160. Descriptions of hydrocracking processes may be found in Hydrocarbon Processing of November 1996 pages 124 to 128. Examples of hydrocracking and its use may be found in U.S. Pat. No. 4,347,124, PCT Publication WO 99/47626 and U.S. Pat. No. 4,447,315, these documents are not however concerned with hydrocarbon fluids.

BRIEF SUMMARY OF THE INVENTION

We have now found that if a vacuum gas oil is hydrocracked, a stream that may be used for the production of hydrocarbon fluids having higher final boiling points and lower sulphur levels may be obtained.

Accordingly the present invention provides the use of a hydrocracked vacuum gas oil as a feed for the production of hydrocarbon fluids having an ASTM D-86 boiling range in the range 100° C. to 400° C., the boiling range being no more than 75° C.

DETAILED DESCRIPTION OF THE INVENTION

A typical vacuum gas oil feed to hydrocracking according to the present invention has the following properties:

Specific Gravity: 0.86-0.94;

ASTM D-1160 distillation: IBP 240° C. -370° C.e, FBP 380-610° C. (here ASTM D-1160 is used due to the high Final Boiling Point);

Aromatics wt %: 1 ring from 13 to 27, 2 ring from 10 to 20, 3 ring from 7 to 11, 4 ring from 6 to 12, total from 40 to 65 (1);

Naphthenes wt %: 1 ring from 2 to 4, 2 ring from 4 to 7, 3 ring from 4 to 6, 4 ring from 4 to 7, total from 16 to 27 (1);

Paraffins wt %: from 7 to 16;

Iso Paraffins wt %: from 8 to 20;

Sulphur: from 1.75 to 3 wt %;

(1) the sum of minima or maxima may not match the total minima or total maxima as the individual minima or maxima may not be reached at the same time.

The sulphur level quoted above (in wt % range) is measured by ASTM D-2622 using X-Ray Fluorescence.

The use of hydrocracked vacuum gas oil for feedstocks to produce the hydrocarbon fluids of the present invention has the following advantages. The feedstocks have lower sulphur content (1 to 15 ppm by weight as opposed to 100 to 2000 ppm by weight in conventional fluid manufacture). The feedstocks also have a lower aromatic content (3 to 30 wt % as opposed to the 15 to 40 wt % in conventional fluid manufacture). The lower sulphur content can avoid or reduce the need for deep hydrodesulphurisation and also results in less deactivation of the hydrogenation catalyst when hydrogenation is used to produce dearomatised grades. The lower aromatic content also diminishes the hydrogenation severity required when producing dearomatised grades thus allowing the debottlenecking of existing hydrogenation units or allowing lower reactor volumes for new units.

The non-dearomatised fluids also have a lower normal paraffin content (3 to 10 wt % as opposed to 15 to 20 wt % in conventional fluid manufacture) and a higher naphthenic content (45 to 75 wt % as opposed to 20 to 40 wt % in conventional fluid manufacture). These products have less odour, improved low temperature properties such as a lower freezing point and pour point and in some applications an improved solvency power. The dearomatised fluids also have a higher naphthenic content (70 to 85 wt % as opposed to 50 to 60 wt %) and have improved low temperature properties and improved solvency power.

We have found that by using a hydrocracked vacuum gas oil as the feed for the production of hydrocarbon fluids, fluids having a final boiling point of 360° C. or higher and a very low sulphur content may be obtained.

Hydrocracked vacuum gas oil cuts may be subject to further processing according to the needs of the fluid. We have found that the hydrocracked vacuum gas oil stream typically contains from 1 to 15 ppm sulphur, irrespective of the final boiling point of the stream, whereas the atmospheric distillates typically contain from 100 to 2000 ppm sulphur. We have also found that the hydrocracked vacuum gas oil stream typically contains from 3 to 30 wt % aromatics, irrespective of the final boiling point of the stream, as opposed to the 15 to 40 wt % aromatics in the atmospheric distillates.

These benefits enable fluids of lower sulphur levels and lower aromatic levels with higher final boiling points to be obtained by subsequent processing of the hydrocracked vacuum gas oil.

The subsequent processing of hydrocracked vacuum gas oil cuts may include, hydrogenation to reduce the level of aromatics and fractionation to obtain a fluid of the desired composition and ASTM D-86 boiling characteristics. We prefer that, when both hydrogenation and fractionation are involved, fractionation takes place before hydrogenation. The fluids that may be produced according to the present invention have a boiling range between 100° C. and 400° C. as measured by ASTM D-86 or equivalent (or ASTM D-1160 may be used if the Final Boiling Point is above 365° C.). The Initial Boiling Point and the Final Boiling Point are therefore both within the range. The boiling range should be no greater than 75° C. and preferably no more than 65° C., more preferably no more than 50° C.; the boiling range being the difference between the Final Boiling Point (or the Dry Point) and the Initial Boiling Point as measured by ASTM D-86. The preferred boiling range will depend upon the use to which the fluid is to be put however, preferred fluids have boiling points in the following ranges:

| | |
|---|---|
| 130° C. to 165° C. | 235° C. to 265° C. |
| 160° C. to 190° C. | 260° C. to 290° C. |
| 185° C. to 215° C. | 290° C. to 315° C. |
| 195° C. to 240° C. | 300° C. to 360° C. |

A fluid having the desired boiling range may be obtained by appropriate fractional distillation of the hydrocracked vacuum gas oil.

In a further embodiment the invention provides processes for the production of hydrocarbon fluids as described below in which no deep additional hydrodesulphurisation process is needed to produce low sulphur hydrocarbon fluids.

In a further embodiment the invention provides a process for the production of hydrocarbon fluids in which a vacuum gas oil is subjected to hydrocracking and a product cut of hydrocracking is subsequently fractionated to produce a hydrocarbon fluid having an ASTM D-86 boiling range in the range 100° C. to 400° C. the boiling range being no greater than 750° C.

In a further embodiment the invention provides a process for the production of hydrocarbon fluids in which a vacuum gas oil is subjected to hydrocracking and a product cut of hydrocracking is fractionated and then hydrogenated to produce a hydrocarbon fluid having an ASTM D-86 boiling range in the range 100° C. to 400° C. the boiling range being no greater than 750° C.

In a further embodiment the invention provides a process for the production of hydrocarbon fluids in which a vacuum gas oil is subjected to hydrocracking and a product cut of hydrocracking is hydrogenated and then fractionated to produce a hydrocarbon fluid having an ASTM D-86 boiling range in the range 100° C. to 400° C. the boiling range being no greater than 75° C.

The term product cut is a product of hydrocracking that has ASTM D-86 boiling ranges within 100° C. to 400° C.

The present invention is illustrated by reference to the accompanying schematic diagram which is FIG. 1.

FIG. 1 shows the elements of a refinery that are involved in the process of the present invention. (1) is a stream of crude oil that is fed to an atmospheric pipe still (2) where the materials boiling in the atmospheric distillation range (not shown) are separated. The residue from the atmospheric distillation is fed from the bottom of the atmospheric distillation column (2) to the vacuum distillation column (3) where vacuum gas oil is taken off as one or more streams (4) and (5). The vacuum gas oil then passes to a hydrocracker (6) from which converted lighter materials are fractionated in various streams such as gas and naphtha (steam 7); jet fuel or kerosene (stream 8) and distillate (or diesel) (stream 9). The kerosene stream (8) and the distillate stream (9) are particularly useful as feedstocks for the production of hydrocarbon fluids. The stream (8) or (9) passes to a storage tank (10) (optional) and then to a fractionator tower (11) where it may be separated into streams to produce hydrocarbon fluids having the desired ASTM D-86 boiling range.

By way of example only the drawing illustrates an embodiment of the invention in which two hydrocarbon fluids are produced having different boiling ranges. The lighter fluid (lower final boiling point) is taken off from the top of the fractionator tower (11) and passes to storage tank (12), then to a hydrogenation unit (13) and then to the storage tank (14). The heavier fluid (higher final boiling point) is taken off as a side stream from the fractionator tower (11) and similarly passes to storage tank (15), then to a hydrogenation unit (16) and finally to storage tank (17).

The present invention is further illustrated by reference to the following Example in which a vacuum gas oil having the following typical composition:

| ASTM D1160 Distillation | IBP 250° C. | FBP 575° C. |
|---|---|---|
| Specific Gravity | 0.92 | |
| Aromatics wt % | 1 ring | 19 |
| | 2 rings | 17 |
| | 3 rings | 10 |

-continued

| ASTM D1160 Distillation | IBP 250° C. | FBP 575° C. |
|---|---|---|
| | 4 rings | 9 |
| | Total | 55 |
| Undefined wt % | 4 | |
| Naphthenes wt % | 1 ring | 3 |
| | 2 rings | 5 |
| | 3 rings | 4 |
| | 4 rings | 4 |
| | Total | 16 |
| Paraffins wt % | 11 | |
| Iso Paraffins wt % | 14 | |
| Sulphur wt % (ASTM D2622) | 2.1 (1) | |

(1) the 2.1 wt % of sulphur is contained within the wt % given for the various chemical families;
IBP means Initial Boiling Point;
FBP means Final Boiling Point.

was hydrocracked in a typical hydrocracker containing two reactors R1 and R2. The conditions in the two reactors were as follows:

| | R1 | R2 |
|---|---|---|
| Temp ° C. | 378 | 354 |
| Pressure kPa | 14800 | 14200 |
| LHSV, $hr^{-1}$ | 0.98 | 0.89 |
| TGR, $Nm^3/l$ | 1588 | 1948 |

LHSV = Liquid Hourly Space Velocity;
TGR = Treat Gas Ratio;
$Nm^3/l$ is normal cubic metres of hydrogen gas per litre of liquid feed.

Following hydrocracking the product was fractionated in a classical fractionator into different cuts (lights, kerosene material cut, diesel material cut, bottoms). The diesel material cut which was used in this invention had the following typical properties:

| | |
|---|---|
| Distillation | |
| ASTM D86 ° C. IBP | 244 |
| 5% | 261 |
| 10% | 268 |
| 20% | 277 |
| 30% | 286 |
| 40% | 294 |
| 50% | 304 |
| 60% | 314 |
| 70% | 326 |
| 80% | 339 |
| 90% | 356 |
| 95% | 368 |
| FBP | 370 |
| Flash Point, ° C. (ASTM D93) | 113 |
| Density, g/ml 15° C. (ASTM D4052) | 0.8558 |
| Aniline Point, ° C. (ASTM D611) | 75.3 |
| Viscosity, cSt 25° C. (ASTM D445) | 7.63 |
| Viscosity, cSt 40° C. (ASTM D445) | 4.98 |
| Sulphur MC, mg/l (ASTM D4045) | 8 |
| Bromine Index, mg/100 g (ASTM D2710) | 341 |
| Chemical Composition | |
| n-Paraffins, wt % | 7.2 |
| Iso-Paraffins, wt % | 17.6 |
| Aromatics, wt % | 18.4 |
| Naphthenes, wt % | 56.7 |
| 1-ring | 18.5 |

-continued

| | |
|---|---|
| 2-rings | 18 |
| 3-rings | 13.9 |
| 4-rings | 6.3 |
| Carbon number distribution wt % | |
| C13 | 11.1 |
| C14 | 10.7 |
| C15 | 11.5 |
| C16 | 10.8 |
| C17 | 9.9 |
| C18 | 9.3 |
| C19 | 8.1 |
| C20 | 6 |
| C21 | 7.8 |
| C22 | 5.3 |
| C23 | 4.2 |
| C24 | 2.9 |
| C25 | 1.6 |
| C26 | 0.6 |
| C27 | 0.2 |

The chemical composition is measured by the methods described previously, the aromatics being determined by liquid chromatography and the carbon number distribution by GC assuming that, for example, all product between the mid point between the nC13 and nC14 peaks and the nC14 and nC14 peaks is C14 material.

Naphthenics are cyclic saturated hydrocarbons and the method used for determination of naphthenic content of the hydrocarbon fluid is based on ASTM D-2786: "Standard test method for hydrocarbon types analysis of gas-oil saturates fractions by high ionising voltage mass spectrometry". This method covers the determination by high ionising voltage mass spectrometry of seven saturated hydrocarbon types and one aromatic type in saturated petroleum fractions having average carbon numbers 16 through 32. The saturate types include alkanes (0-rings), single ring naphthenes and five fused naphthene types with 2, 3, 4, 5 and 6 rings. The non-saturate type is monoaromatic.

The samples must be non-olefinic and must contain less than 5 volume % monoaromatics. This is mostly the case for product samples. For feedstock sample analysis when aromatics are usually higher than 5 volume %, the aromatics are separated and determined by Liquid Chromatography or by Solid Phase Extraction.

The normal paraffins are separated and determined by Gas Chromatography upstream of the mass spectrometer. It is preferred to have the normal paraffins below 10 wt %. The relative amounts of alkanes (0-ring), 1-ring, 2-ring, 3-ring, 4-ring, 5-ring and 6-ring naphthenics is determined by a summation of mass fragment groups most characteristic of each molecular type. Calculations are carried out by the use of inverted matrices that are specific for any average carbon number. The fluids produced according to the present invention contain at least 40 wt %, preferably at least 60 wt %, naphthenics and at least 20 wt %, preferably at least 30 wt % more preferably at least 45 wt % of 2-ring, 3-ring, 4-ring, 5-ring and 6-ring naphthenics. From the relative amount of alkanes, the amount of iso paraffins can be determined by deducting the amount of normal paraffins from the amount of total alkanes.

The aromatics content of the fluids is measured by ultra violet absorption and the carbon number distribution is obtained by GC.

The hydrocracked diesel was fractionated to produce different cuts being 0 vol % to 40 vol % and 40 vol % to 95 vol % of the hydrocracked diesel.

These cuts were then hydrogenated using the following conditions:

Temperature: 200° C.;

Pressure: 2700 kPa;

Liquid Hourly Space Velocity: 1 $hr^{-1}$;

Treat Gas Ratio: normal cubic metres of hydrogen gas per litre of liquid feed.

The properties of the materials obtained are set out in following Table 1.

TABLE 1

| | Hydrogenated Hydrocrackate Diesel 0-40% Volume cut | Hydrogenated Hydrocrackate Diesel 40-95% Volume cut |
|---|---|---|
| DISTILLATION RANGE ASTM D86 | | |
| IBP | 237 | 305 |
| 50% | 262 | 324 |
| DP (Dry Point) | | 361 |
| FBP | 287 | 364 |
| Aniline Point ° C. ASTM D611 | 75.6 | 91.2 |
| Density @ 15° C., g/ml ASTM D4052 | 0.8423 | 0.8472 |
| Viscosity | | |
| @ 25° C.-cSt ASTM D445 | 4.12 | 12.4 |
| @ 40° C.-cSt ASTM D445 | 2.96 | 7.65 |
| Flash Point ASTM D93 | 100 | 54 |
| Refractive Index @ 20° C. | 1.46 | 1.464 |
| COLD PROPERTIES | | |
| Pour Point ° C. ASTM D97 | −40 | −6 |
| Freezing Point ° C. ASTM D2386 | not tested | +5 |
| Cloud Point ° C. ASTM D5772 | not tested | +2.5 |
| Wt % Aromatics by UV | 0.0042 | 0.19 |
| Composition, wt % | 6 | 6.1 |
| Normal Paraffins | | |
| ISO Paraffins | 15.1 | 23.2 |
| Total Aromatics | 0 | 0 |
| Total Naphthenics | 78.9 | 68.7 |
| 1-ring | 25.3 | 24.8 |
| 2-rings | 31.5 | 21.5 |
| 3-rings | 19.5 | 14.2 |
| 4-rings | 2.6 | 8.3 |
| 5-rings | 0 | 0 |
| Carbon No. distribution Capillary Column wt % | | |
| Up to C13 | 13.8 | |
| C14 | 16.2 | |
| C15 | 26.8 | |
| C16 | 22.9 | 3.1 |
| C17 | 16.7 | 12.4 |
| C18 | 3.5 | 16.1 |
| C19 | 0.1 | 15.8 |
| C20 | | 13.7 |
| C21 | | 12.4 |
| C22 | | 10.7 |
| C23 | | 8.1 |
| C24 | | 4.7 |
| C25 | | |
| C26 | | 0.7 |
| C27 | | 0.2 |

The fluids produced by the present invention have a variety of uses in for example drilling fluids, industrial solvents, in printing inks and as metal working fluids, such as cutting fluids and aluminium rolling oils, the Initial Boiling Point to Final Boiling Point boiling range being selected according to the particular use. The fluids are however particularly useful as components in silicone sealant formulations where they act as extender oils and as extenders or viscosity depressants for polymer systems such as plasticised polyvinyl chloride formulations.

The fluids produced according to the present invention may also be used as new and improved solvents, particularly as solvents for resins. The solvent-resin composition may comprise a resin component dissolved in the fluid, the fluid comprising 5-95% by total volume of the composition.

The fluids produced according to the present invention may be used in place of solvents currently used for inks, coatings and the like.

The fluids produced according to the present invention may also be used to dissolve resins such as:

a) acrylic-thermoplastic;
b) acrylic-thermosetting;
c) chlorinated rubber;
d) epoxy (either one or two part);
e) hydrocarbon (e.g., olefins, terpene resins, rosin esters, petroleum resins, coumarone-indene, styrene-butadiene, styrene, methyl-styrene, vinyl-toluene, polychloroprene, polyamide, polyvinyl chloride and isobutylene);
f) phenolic;
g) polyester and alkyd;
h) polyurethane;
i) silicone;
j) urea; and,
k) vinyl polymers and polyvinyl acetate.

Examples of the type of specific applications for which the fluids and fluid-resin blends may be used include coatings, cleaning compositions and inks.

For coatings the blend preferably has a high resin content, i.e., a resin content of 20%-60% by volume. For inks, the blend preferably contains a lower concentration of the resin, i.e., 5%-30% by volume. In yet another embodiment, various pigments or additives may be added.

The fluids produced by the present invention can be used as cleaning compositions for the removal of hydrocarbons or in the formulation of coatings or adhesives. The fluids may also be used in cleaning compositions such as for use in removing ink, more specifically in removing ink from printing machines.

In the offset printing industry it is important that ink can be removed quickly and thoroughly from the printing surface without harming the metal or rubber components of the printing machine. Further there is a tendency to require that the cleaning compositions are environmentally friendly in that they contain no or hardly any aromatic volatile organic compounds and/or halogen containing compounds. A further trend is that the compositions fulfil strict safety regulations. In order to fulfil the safety regulations, it is preferred that the compositions have a flash point of more than 62° C., more preferably a flash point of 90° C. or more. This makes them very safe for transportation, storage and use. The fluids produced according to the present invention have been found to give a good performance in that ink is readily removed while these requirements are met.

The fluids produced according to this invention are also useful as drilling fluids, such as a drilling fluid which has the fluid of this invention as a continuous oil phase. The fluid may also be used as a rate of penetration enhancer comprising a continuous aqueous phase containing the fluid produced according to this invention dispersed therein.

Fluids used for offshore or on-shore applications need to exhibit acceptable biodegradability, human, eco-toxicity, eco-accumulation and lack of visual sheen credentials for them to be considered as candidate fluids for the manufacturer of drilling fluids. In addition, fluids used in drilling need to possess acceptable physical attributes. These generally include a viscosity of less than 4.0 cSt at 40° C., a flash value of less than 100° C. and, for cold weather applications, a pour point of −40° C. or lower. These properties have typically been only attainable through the use of expensive synthetic fluids such as hydrogenated polyalpha olefins, as well as unsaturated internal olefins and linear alpha-olefins and esters. The properties can however be obtained in some fluids produced according to the present invention Drilling fluids may be classified as either water-based or oil-based, depending upon whether the continuous phase of the fluid is mainly oil or mainly water. Water-based fluids may however contain oil and oil-based fluids may contain water and the fluids produced according to this invention are particularly useful as the oil phase.

Typically preferred ASTM D-86 boiling ranges for the uses of the fluids are that printing ink solvents (sometimes known as distillates) have boiling ranges in the ranges 235° C. to 265° C., 260° C. to 290° C. and 280° C. to 315° C. Fluids preferred for use as drilling fluids have boiling ranges in the ranges 195° C. to 240° C., 235° C. to 265° C. and 260° C. to 290° C. Fluids preferred for metal working having boiling ranges in the ranges 185° C. to 215° C., 195° C. to 240° C., 235° C. to 365° C., 260° C. to 290° C., 280° C. to 315° C. and 300° C. to 360° C. Fluids preferred as extenders for silicone sealants having boiling ranges in the ranges 195° C. to 240° C., 235° C. to 265° C., 260° C. to 290° C., 280° C. to 315° C. or 300° C. to 360° C. Fluids preferred as viscosity depressants for polyvinyl chloride plastisols have boiling ranges in the ranges 185° C. to 215° C., 195° C. to 240° C., 235° C. to 265° C., 260° C. to 290° C., 280° C. to 315° C. and 300°C. to 360° C.

The invention claimed is:

1. A process for the production of hydrocarbon fluids comprising subjecting a vacuum gas oil to hydrocracking to form a product cut of hydrocracking characterized by a content of 1-15 ppm sulfur and 3-30 wt % aromatics, fractionating and hydrogenating the product cut to produce a hydrocarbon fluid having less than 2 wt % aromatics, at least 40 wt % naphthenics, and an ASTM D-86 boiling range in the range 100° C. to 400° C., wherein the boiling range is no greater than 65° C.

2. A process for the production of hydrocarbon fluids according to claim 1, comprising subjecting a vacuum gas oil to hydrocracking to form a product cut of hydrocracking, fractionating the product cut to form a factionated product cut and then hydrogenating the fractionated product cut produce a hydrocarbon fluid having an ASTM D-86 boiling range in the range 100° C. to 400° C., wherein the boiling range is no greater than 75° C.

3. A process for the production of hydrocarbon fluids according to claim 1, comprising subjecting a vacuum gas oil to hydrocracking to form a product cut of hydrocracking, hydrogenating the product cut to form a hydrogenated product cut and fractionating the hydrogenated product cut to produce a hydrocarbon fluid having an ASTM D-86 boiling range in the range 100° C. to 400° C., wherein the boiling range is no greater than 75° C.

4. The process according to claim 3, wherein the vacuum gas oil has a Specific Gravity in the range 0.86 to 0.94 and an Initial Boiling Point (ASTM D-1160) in the range 240° C. to 370° C. and a Final Boiling Point (ASTM D-1160) in the range 380° C.-610° C.

5. The process according to claim 3, wherein the vacuum gas oil to hydrocracking comprises from 40 to 65 wt % total aromatics, the total aromatics comprising from 13 to 27 wt % 1 ring compound; from 10 to 20 wt % 2 ring compounds; from 7 to 11 wt % 3 ring compounds; and from 6 to 12 wt % 4 ring compounds; from 16 to 27 wt % total naphthene comprising from 2 to 4 wt % 1 ring compounds; from 4 to 7 wt % 2 ring compounds; from 4 to 6 wt % 3 ring compounds; and from 4 to 7 wt % 4 ring compounds; from7to l6wt % Paraffins; from 8 to 20 wt % Iso Paraffins; and from 1.75 to3 wt % Sulphur.

6. A process according to claim 1, wherein said hydrocarbon fluid has a boiling range of no greater than 500° C.

7. A hydrocarbon fluid produced by the process of claim 1, said hydrocarbon fluid having the ASTM D-86 boiling range in the range 130° C. to 165° C.

8. The hydrocarbon fluid produced by the process of claim 1, said hydrocarbon fluid having the ASTM D-86 boiling range is in the range 160° C. to 1900° C.

9. The hydrocarbon fluid produced by the process of claim 1. said hydrocarbon fluid having the ASTM D-86 boiling range is in the range 185° C. to 215° C.

10. The hydrocarbon fluid produced by the process of claim 1, said hydrocarbon fluid having the ASTM D-86 boiling range is in the range 195° C. to 240° C.

11. The hydrocarbon fluid produced by the process of claim 1, said hydrocarbon fluid having the ASTM D-86 boiling range is in the range 235° C. to 265° C.

12. The hydrocarbon thud produced by the process of claim 1, said hydrocarbon fluid having the ASTM D-86 boiling range is in the range 260° C. to 290° C.

13. The hydrocarbon fluid produced by the process of claim 1, said hydrocarbon fluid having the ASTM D-86 boiling range is in the range 290° C. to 315° C.

14. The hydrocarbon fluid produced by the process of claim 1, said hydrocarbon fluid having the ASTM D-86 boiling range is in the range 300° C. to 360° C.

15. A chilling fluid comprising a hydrocarbon fluid produced by the process according to claim 1 and an oil-based continuous phase or a water-based continuous phase.

16. A metal working fluid comprising a hydrocarbon fluid produced by the process according to claim 1 and an additive selected from extreme pressure agents, antioxidants. biocides and emulsifiers.

17. The process according to claim 1, wherein said hydrocarbon fluid contains at least at least 60 wt % naphthenics.

18. The process according to claim 1, wherein said hydrocarbon fluid contains 70-85 wt % naphthenics.

19. A composition comprising a hydrocarbon fluid produced by the process according to claim 1, further comprising a resin selected from at least one of the group consisting of acrylic-thermoplastic; acrylic-thermosetting; chlorinated rubber; epoxy (either one or two part); olefins; terpene resins; rosin esters; petroleum resins; coumarone-indene; styrene-butadiene; styrene; methyl-styrene; vinyl-toluene; polychloroprene; polyamide; polyvinyl chloride; isobutylene; phenolic; polyester; alkyd; polyurethane; silicone; urea; vinyl; and polyvinyl acetate.

20. A silicone sealant composition comprising as an extender fluid a hydrocarbon fluid produced by the process according to claim 1.

* * * * *